US006646612B1

(12) United States Patent
Noguchi et al.

(10) Patent No.: US 6,646,612 B1
(45) Date of Patent: Nov. 11, 2003

(54) NON-DIRECTIVITY ANTENNA FOR WIRELESS LAN

(75) Inventors: Wataru Noguchi, Nagoya (JP); Nagahiro Matsuura, Nagoya (JP)

(73) Assignee: Melco Inc., Aichi-Ken (JP)

( * ) Notice: Subject to any disclaimer, the term of this patent is extended or adjusted under 35 U.S.C. 154(b) by 0 days.

(21) Appl. No.: 10/146,665

(22) Filed: May 13, 2002

(51) Int. Cl.[7] ..... H01Q 1/24
(52) U.S. Cl. ..... 343/702; 343/791; 343/882
(58) Field of Search ..... 343/702, 878, 343/880, 882, 900

(56) References Cited

U.S. PATENT DOCUMENTS 5,644,320 A * 7/1997 Rossi ..... 343/702
6,023,249 A * 2/2000 Fujita et al. ..... 343/883
6,292,146 B1 * 9/2001 Melax ..... 343/702
6,362,794 B1 * 3/2002 Yu ..... 343/702
6,475,022 B2 * 11/2002 Tomino et al. ..... 439/449
6,522,303 B1 * 2/2003 West et al. ..... 343/770

* cited by examiner

*Primary Examiner*—Don Wong
*Assistant Examiner*—Shih-Chao Chen
(74) *Attorney, Agent, or Firm*—Beyer Weaver & Thomas

(57) ABSTRACT

An antenna device for wireless LAN of the present invention includes a base module and an antenna case that receives a built-in antenna therein. A metal reflector plate is held in a base element of the base module. The reflector plate functions to widen the range of directivity of the antenna device and thus ensures stable communication for wireless LAN. The antenna case is pivotable to the base module. The antenna is adjustable to a desired angle according to the requirement, so as to attain communication for wireless LAN.

9 Claims, 9 Drawing Sheets

DIRECTIVITY CHARACTERISTICS
IN HORIZONTAL PLANE

DIRECTIVITY CHARACTERISTICS
IN VERTICAL PLANE

NON-DIRECTIVITY ANTENNA FOR WIRELESS LAN

TECHNICAL FIELD OF THE INVENTION

The present invention relates to an antenna used for wireless LAN and a wireless LAN device, and more specifically pertains to improvement of a non-directivity antenna for wireless LAN.

BACKGROUND OF THE INVENTION

The technique of wireless LAN has become common with a wide spread of the Internet and Intranets utilizing TCP/IP, one basic technique of the Internet. In the technique of wireless LAN, a wireless LAN device, instead of the conventional LAN cable, such as 10Base-T, is used for connection of the network with a computer. The wireless LAN device includes a pair of receiver-transmitter units. One unit is connected to the computer, while the other unit is connected to the LAN. There is communication between the pair of units by a power-saving communication technique with sufficient reliability, for example, Spread-Spectrum. The wireless LAN device enables the computer to freely access the Internet and Intranets, as in the case of wired connection with a LAN cable.

The wireless LAN device is used in a distance sufficiently communicable with an internal antenna, and is thus mainly used indoors. In the indoor use, however, the units of the wireless LAN device may be apart from each other by a relatively large distance, or some obstacle that interferes with smooth wireless communication, such as a tall bookcase, may be present between the units of the wireless LAN device. In such cases, sufficiently high-grade communication is not attainable with only the internal antenna. The lowered grade of communication and a resulting increase in noise may cause failure of communication or increase mistakes in communication. The increased mistakes in communication take time for their correction and retransmission, thus undesirably lowering the substantial communication speed.

External antennas have bean used for improvement in state of communication between wireless LAN devices. The external antennas include directivity antennas and non-directivity antennas. The directivity antenna is advantageous for high-grade communication between antennas facing each other, but has a low degree of freedom in installation. The non-directivity antenna, or the other hand, an allows communication in a wide surrounding range and accordingly has a high degree of freedom in installation.

SUMMARY OF THE INVENTION

The object of the present invention is thus to widen a communicable range in a vertical direction of an antenna device for wireless LAN utilizing a non-directivity antenna. The antenna device for wireless LAN includes a base module having a predetermined area, and an electrically conductive reflector plate held in the based module. An antenna main body having no directivity around an axis is received in a columnar case, which is connected to the base module with a degree of freedom in at least one axis. In the antenna device for wireless LAN, the reflector plate held in the base module widens the range of directivity in the vertical direction, thus enhancing the communication performance of the external antenna in offices and other places.

In this antenna device, the columnar case is connected to the base module with the degree of freedom in at least one axis. The angle of the case is accordingly variable in an allowed direction. While the antenna has non-directivity around the axis, the directivity of the antenna is adjustable in the vertical direction, so that the antenna can be installed at a desired direction that ensures stable communication.

MODES OF CARRYING OUT THE INVENTION

Figure 3:
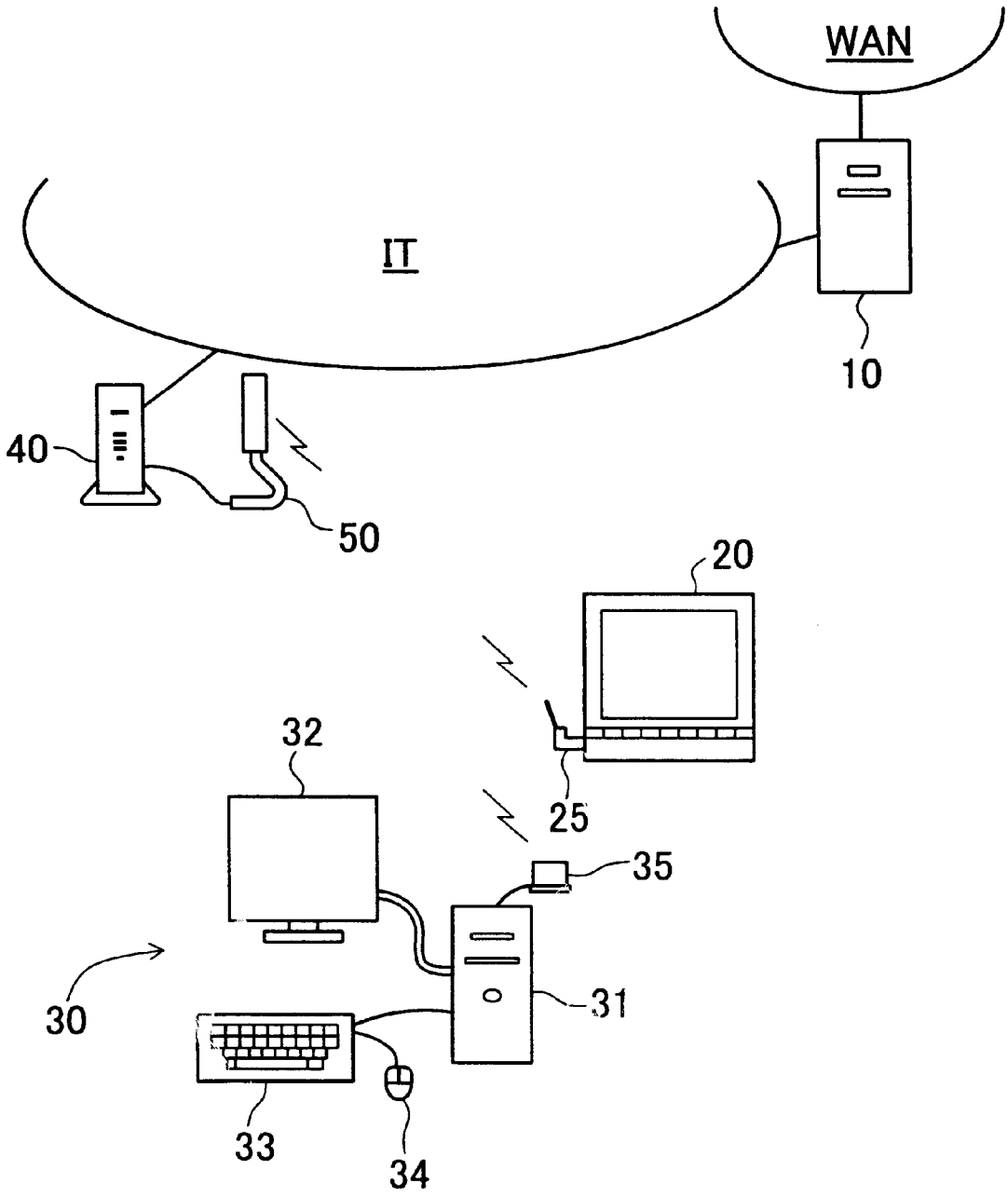
FIG. 3 schematically shows the configuration of a network including the antenna device 50 for wireless LAN as an external antenna.

The following describes a best mode of carrying out the present invention. The construction of a system using an antenna device 50 for wireless LAN is discussed first. FIG. 3 is a block diagram schematically illustrating the construction of a system including multiple computers connecting with an Intranet IT via this antenna device for wireless LAN as an external antenna. As illustrated, a server 10 adopting LINUX (trade mark) as its operating system is connected to the Intranet IT. The Intranet IT is linked with the Internet, an external wide area network (WAN) via the server 10. A router 40 for building a wireless LAN is further connected to the Intranet IT. The antenna device 50 for wireless LAN (hereafter simply referred to as the antenna device 50) functioning as the external antenna is linked with this router 40. The router 40 may be connectable directly with the Internet.

The router 40 establishes wired connection with the Intranet IT and is communicable with computers 20 and 30 by general-purpose TCP/IP via the antenna device 50, so as to connect these computers 20 and 30 with the Intranet IT. As shown in FIG. 3, the computer 20 is a book computer and establishes wireless communication with the router 40 via a wireless LAN card 25 inserted in a card slot thereof. The computer 30 includes a main body 31 having a processor, a ROM, a RAM, and a hard disk, a display 32, a keyboard 33, a mouse 34, and a wireless LAN device 35. The computer 30 communicates with the router 40 via the wireless LAN device 35.

Communication between the wireless LAN card 25, the wireless LAN device 35, and the router 40 adopts a protocol in conformity with IEEE802. 11*b* (Wireless LAN Standard Protocol), and Direct-Sequence Spread-Spectrum (DS-SS), half duplex is applied for transmission. The frequency of transmitted wave is a 2.5 GHz band, and 14 channels are usable at the maximum.

The router 40 has a built-in antenna, but connection with the antenna device 50 extends the transmittable distance. In this embodiment, under the condition of a transfer capacity of 1M, while the effective distance of the internal antenna was 115 meters (indoors), connection with the antenna device 50 extended the effective distance to 140 meters (indoors). Although the antenna device 50 is connected with only the router 40 in this embodiment, the antenna device 50 may further be connected with the wireless LAN device 35. Connection of the antenna device 50 with the two transmitter-receiver units extended the indoor transmittable distance to about 330 meters.

Figure 1:
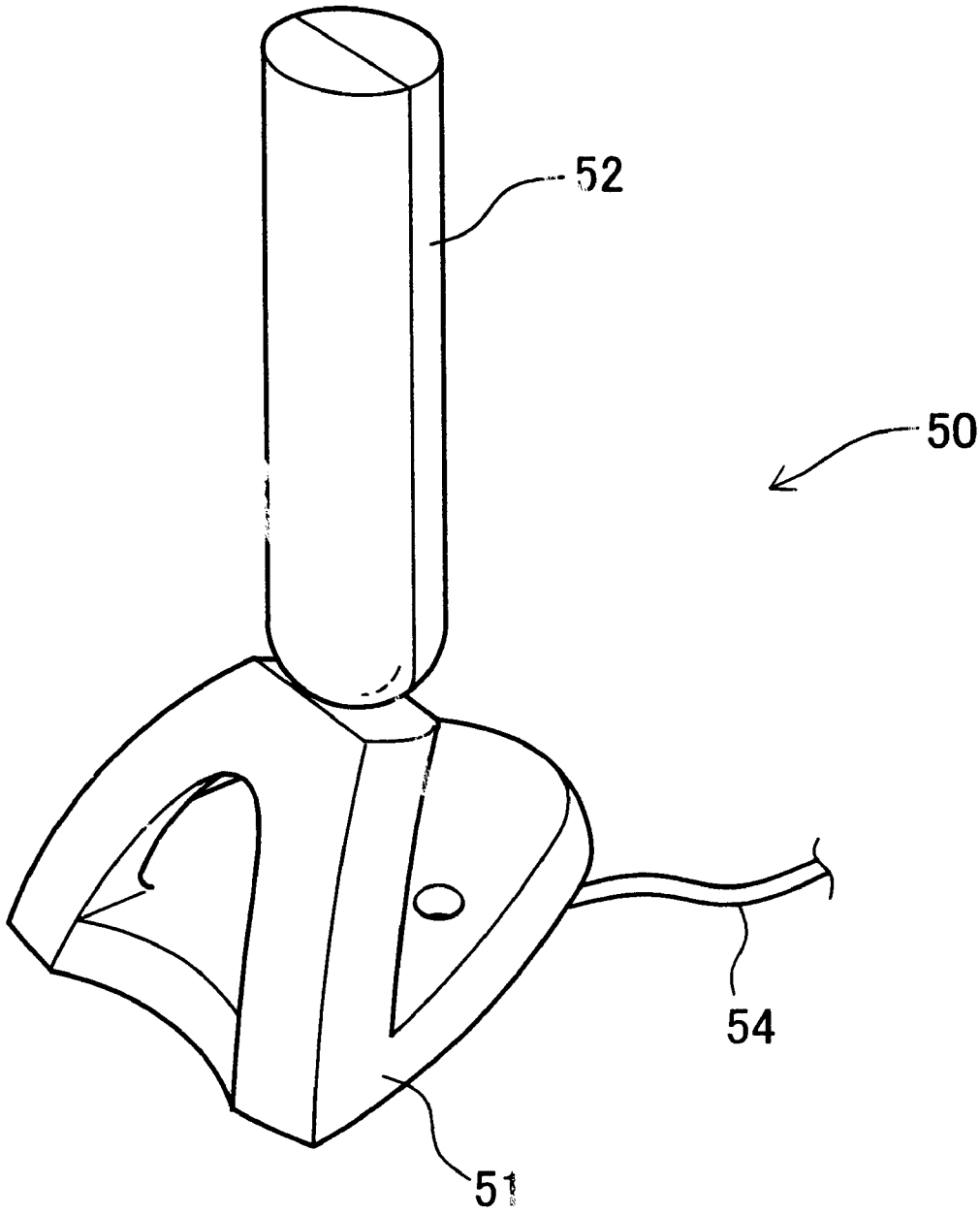
FIG. 1 is a perspective view illustrating the appearance of an antenna device 50 for wireless LAN in one embodiment of the present invention.

The following describes the structure of the antenna device 50 wireless LAN. FIG. 1 is a perspective view illustrating the appearance of the antenna device 50 for wireless LAN of the embodiment. The antenna device 50 includes a base module 51, an antenna case 52 that is attached to the top of the base module 51, and cable 54 that is used for connection of the antenna device 50 with the router 40 or another equivalent element. One end of the cable 54 forms a connector 55 for connection. The antenna case 52 is formed by bonding a pair of plastic cases split along its axis, and receives an antenna main body therein. The antenna used here is a known high-sensitive antenna.

Figure 2A:
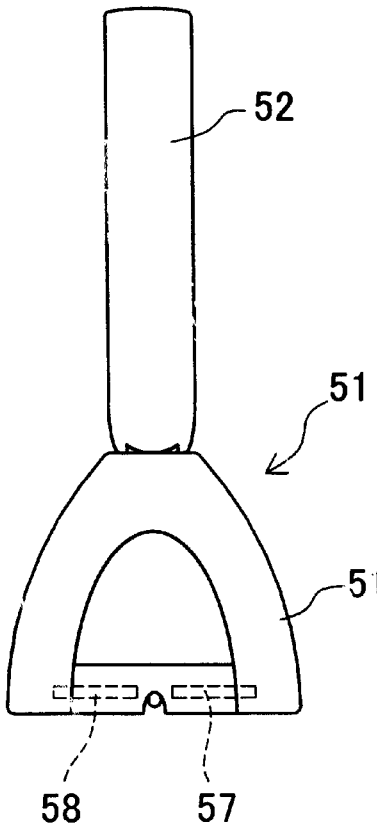
FIGS. 2A and 2B are a front view and a side view of this antenna device 50.
Figure 2B:
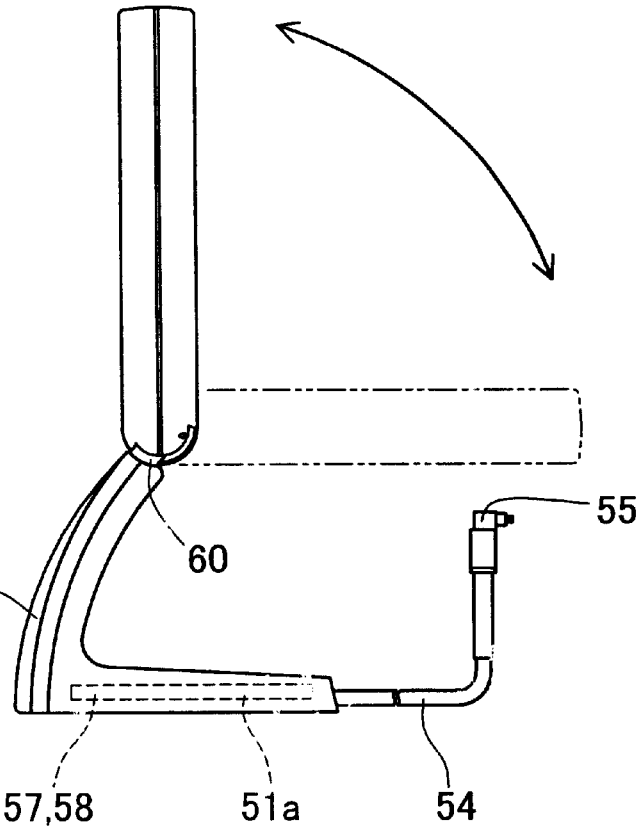

The base module 51 of the antenna device 50 includes a flat base element 51*a* and a pair of legs 51*b* extended in an arch shape from one end of the base element 51*a*, as shown in FIGS. 2A and 2B. The cable 54 that is electrically connected with the built-in antenna and links the antenna with the router 40 passes through the base element 51*a* and one of the legs 51*b* to be wired to the antenna case 52. The antenna case 52 is pivotably attached to the top the legs 51*b* by means of a joint element 60 as shown in FIG. 2B. The antenna case 52 is rotatable in a range of about 90 degrees between a substantially upright position and a substantially parallel position to the base element 51*a* about the joint element 60 as the supporting point.

Figure 4:
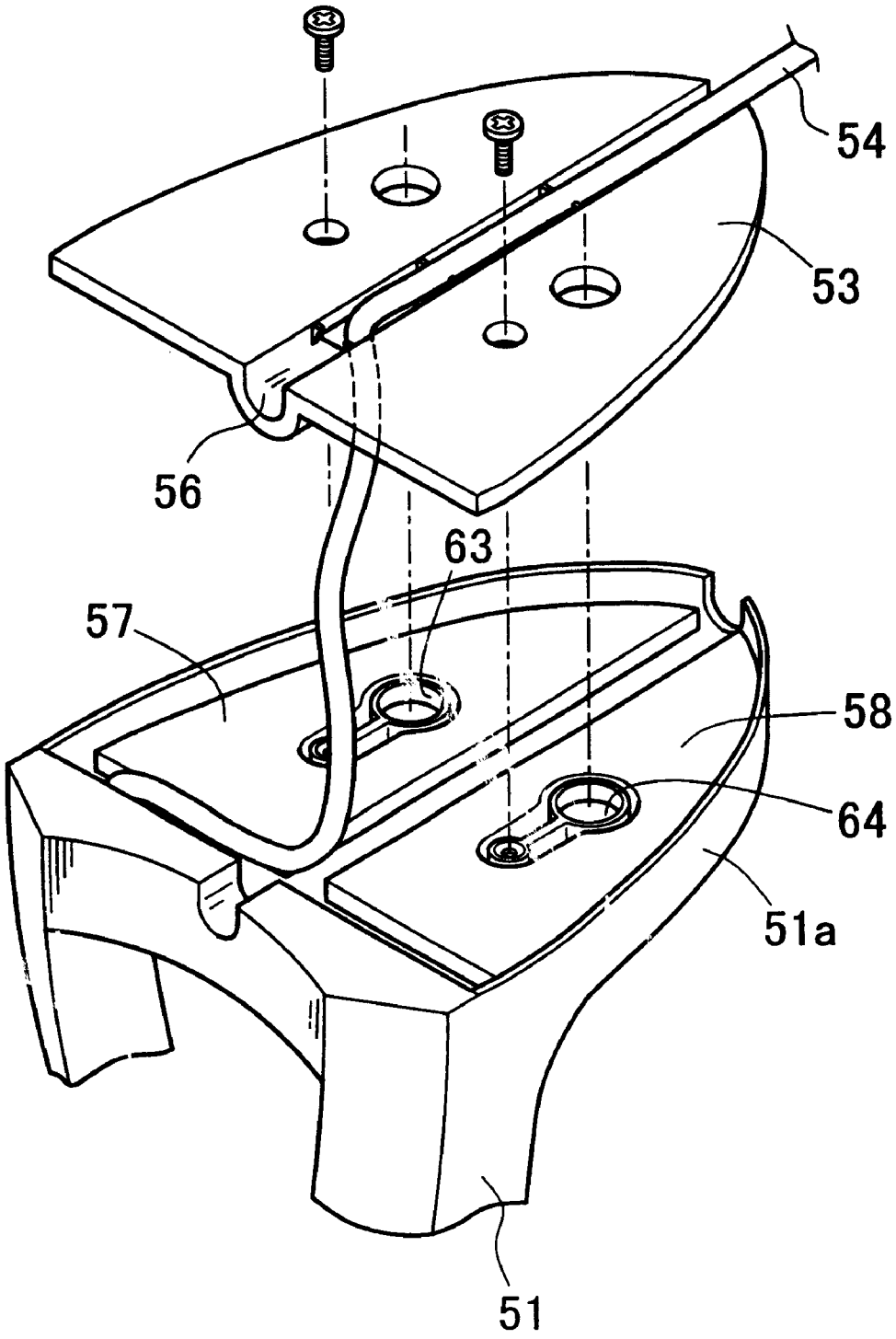
FIG. 4 is a decomposed perspective view illustrating the structure of a base module in the antenna device 50 for wireless LAN of the embodiment.

The base element 51 is made of a synthetic resin, and holds a pair of metal reflector plates 57 and 58 therein. The structure of the base element 51*a* with the reflector plates 57 and 58 held therein is described in detail with reference to FIG. 4. FIG. 4 is a decomposed perspective view illustrating the base element 51*a* decomposed from the rear face. As illustrated, the base element 51*a* has a cover plate 53 fixed to the rear face thereof with two screws. The cover plate 53 has a quasi-semicircular shape corresponding to the shape of the base element 51*a*, and includes a groove 56 formed along its symmetrical axis. The groove 56 has an opening that receives the cable 54 passing therethrough. The cable 54 wired along the groove 56 enters the base element 51*a* via the opening, and goes through one of the legs 51*b* to be joined with the antenna case 52.

The groove 56 in the cover plate 53 divides the inside of the base element 51*a* into left and right sections, which respectively receive the reflector plates 57 and 58 therein. The reflector plates 57 and 58 are metal members of an identical shape, and one reflector plate is turned upside down. Each of the reflector plates 57 and 58 has an opening on a substantial center thereof, in which a screw hole and a penetration element 63 or 64 that penetrates the base element 51*a* are arranged. The penetration elements 63 and 64 are used for fixation of the antenna device 50 to a wall surface or another suitable surface.

Figure 5A:
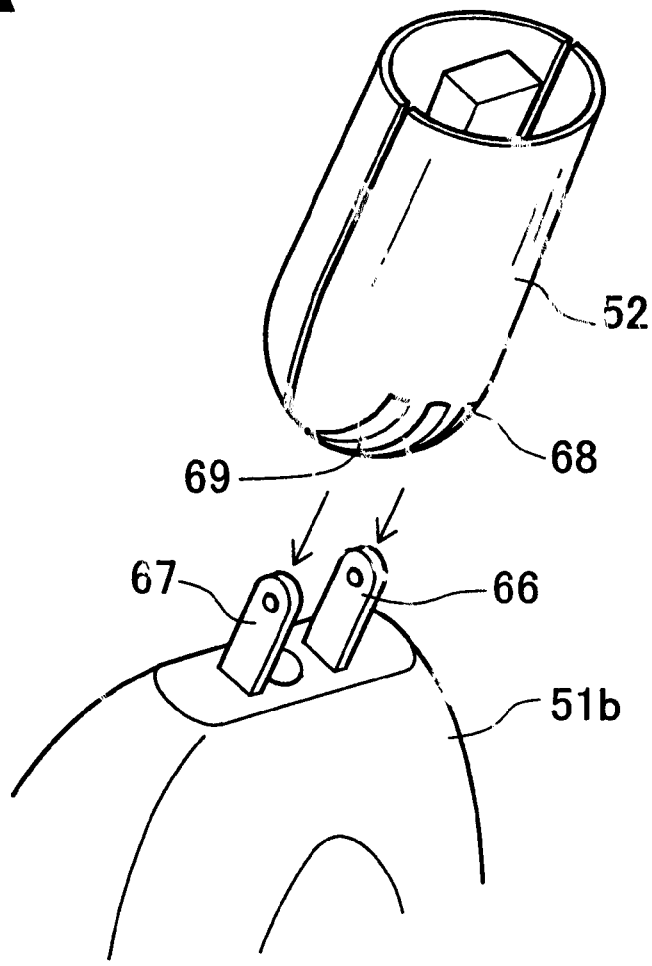
FIG. 5A is a perspective view showing connection of the base module with a case in the antenna device for wireless LAN of the embodiment.
Figure 5B:
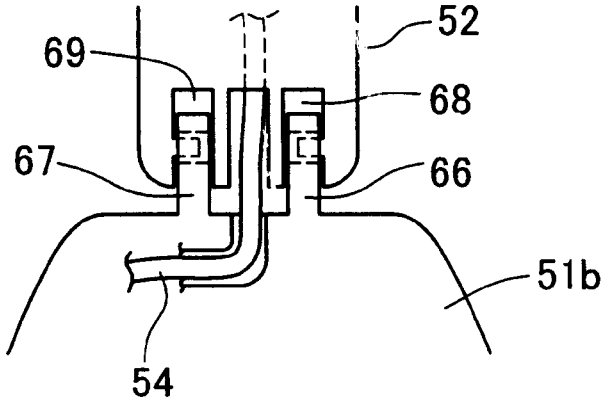
FIG. 5B schematically illustrates a mechanism of the connection.

Two arms 66 and 67 are extended from the top of the legs 51*b* as shown in FIG. 5A. Each of these arms 66 and 67 has an aperture formed on its end. The antenna case 52 has slits 68 and 69 at positions corresponding to these arms 66 and 67. In assembly, the arms 66 and 67 are inserted into the slits 68 and 69 of the antenna case 52. As shown in FIG. 5B, projections 72 and 73 are formed on the inner wall of the slits 68 and 69. These projections 72 and 73 are fitted in the apertures on the respective ends of the arms 66 and 67. The antenna case 52 is thereby pivotable about the fitting of the projections 72 and 73 and the apertures as the supporting point. Rotation of the antenna case 52 is restricted by contact of the arms 66 and 67 with ends of the slits. Each of the slits 68 and 69 has one shallower end and the other deeper end. The antenna case 52 is accordingly rotatable from the substantially upright position shown by the solid lines in FIGS. 1 and 2 to the substantially horizontal position shown by the one-dot chain line in FIG. 2B.

There is an opening between the two arms 66 and 67 to receive the cable 54 therein. The cable 54 passes through this opening and is drawn into the antenna case 52. The cable 54 is eventually connected to an antenna terminal of the router 40 as shown in FIG. 3, and the antenna device 50 functions as the external antenna of the router 40. The antenna device 50 is used to extend the transmittable distance of wireless LAN between the router 40 and the other computers 20 and 30. The antenna device 50 of this embodiment is a non-directivity antenna, and forms an electric field of a substantially equal intensity around the circumference in the horizontal direction when the antenna case 52 is oriented vertically. In the actual application, it is improbable that the router 40 and the computers 20 and 30 are laid out in an identical horizontal plane without any obstacles. The distribution of the electric field formed in the vertical direction also affects the transmittable range of wireless LAN.

Figure 6A:
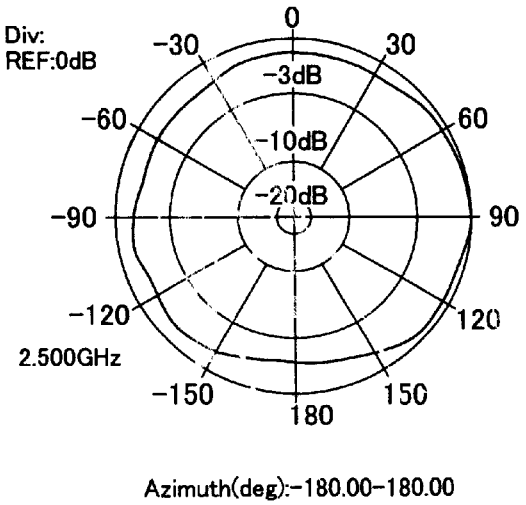
FIGS. 6A and 6B are graphs showing the electric field intensity in a horizontal plane of the external antenna in the embodiment and in a comparative example.
Figure 6B:
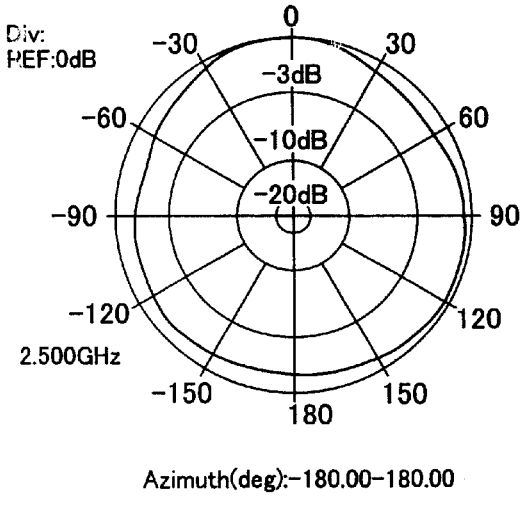
Figure 7A:
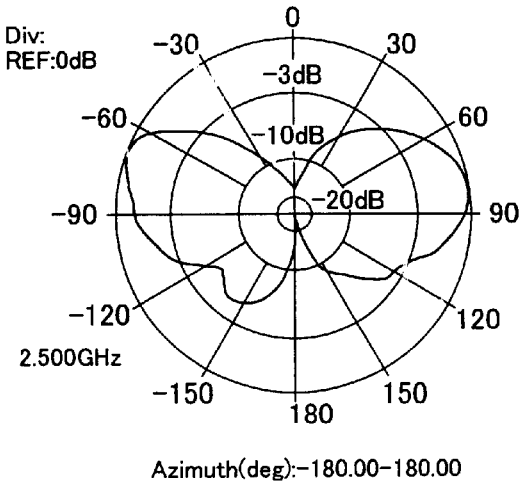
FIGS. 7A and 7B are graphs showing the electric field intensity in a vertical plane of the external antenna in the embodiment and in the comparative example.
Figure 7B:
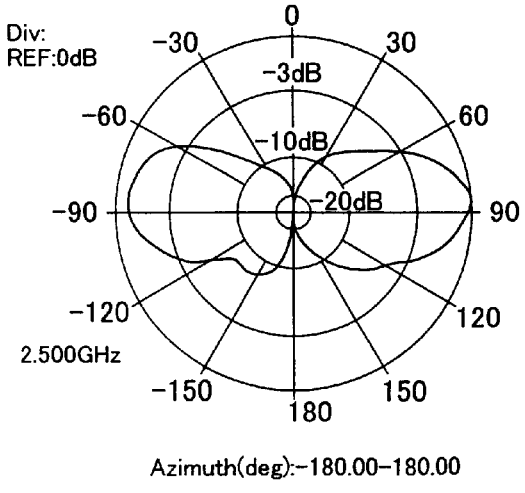
Figure 8:
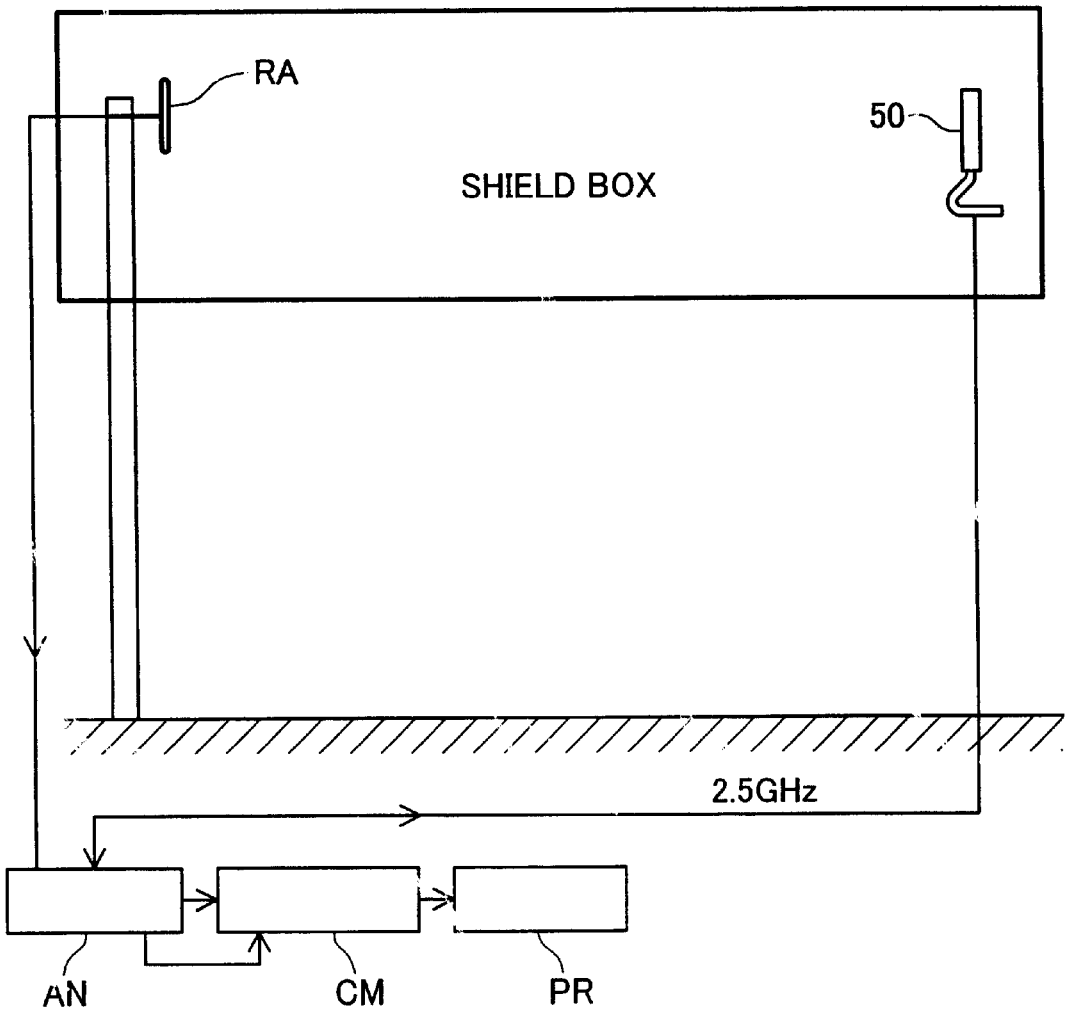
FIG. 8 shows a method of measuring the electric field intensity.

The distribution of the electric field formed by the antenna device 50 of the embodiment was measured. FIGS. 6A and 7A are graphs showing the observed directivity characteristics in a horizontal plane and in a vertical plane with regard to the antenna device 50 of the embodiment. FIGS. 6B and 7B are graphs showing the observed directivity characteristics in the horizontal plane and in the vertical plane with regard to an antenna device of a comparative example. A measuring device shown in FIG. 8 was used for the measurement. The antenna device 50 of the embodiment or the antenna device of the comparative example was located in a shield box, where reflection of radio waves from the inner wall surface was substantially set equal to zero. A carrier wave of 2.5 GHz was transmitted from the antenna device 50. A receiving antenna RA was located apart from the antenna device 50 by a predetermined distance and detected the electric field intensity. An analyzer AN that connects with the receiving antenna RA and the antenna device 50, a computer CM that inputs data from the analyzer AN, and a printer PR that prints results of the processing by the computer CM were used for the measurement. The graphs of FIGS. 6A through 7B are printouts of the printer PR. In these graphs showing the directivity characteristics, the intensity at a specific angle having the maximum electric field intensity is set equal to a value '1' (=0 dB), and a variation in electric field intensity with a variation in angle is expressed by a ratio (dB). The range of the angle having the energy of radio waves to half the maximum level, that is, the range of the angle having a decrease in ratio of the electric field intensity to −3 dB is regarded as the directivity of the antenna.

While the antenna device 50 was rotated successively, the directivity characteristics in the horizontal plane were measured. If the shield box is sufficiently large, one preferable procedure sets the antenna device 50 on the center of the shield box, arranges a plurality of the receiving antennas RA to surround the antenna device 50, and processes the signals from the respective receiving antennas RA. The directivity characteristics in the vertical direction were measured, while the antenna device 50 was successively inclined in the vertical direction to the elevation angle of 90 degrees and the depression angle of 90 degrees. Note that not only the antenna arm 52 is rotated but the whole antenna device 50 is a inclined. If the shield box is sufficiently large, one preferable procedure arranges a plurality of the receiving antennas RA in a vertical plane relative to the antenna device 50 and processes the signals from these receiving antennas.

The antenna device 50 of the embodiment and the antenna device of the comparative example used in the measurements of FIGS. 6A through 7B are identical, except the presence of the reflector plates 57 and 58. In the antenna device 50 of the embodiment, the metal reflector plates 57 and 58 are held in the base element 51*a* of the base module 51. The antenna device of the comparative example, on the other hand, does not have the reflector plates. Comparison between FIGS. 6A and 6 shows no significant difference in electric field intensity in the horizontal plane, regardless of the presence of the reflector plates 57 and 58. There is, however, a significant difference in distribution of the electric field intensity in the vertical plane. The antenna device 50 of the embodiment with the reflector plates 57 and 58 has a wider range of the distribution of the electric field intensity (see FIG. 7(A)) and a wider range of the decrease to −3 dB representing the directivity.

In many offices, the antenna device 50 is placed on a bookcase or screwed to the wall surface. With a view to avoiding the effects of obstacles, such as cabinets and partitions in the office, the antenna device 50 is disposed at a relatively high position. The computers 20 and 30 are generally located on the desk of the respective users. There is accordingly a distance in the vertical direction between the devices involved in communication of wireless LAN. The antenna device 50 of the embodiment and the wireless LAN device connecting therewith extend the distribution of the electric field intensity in the vertical direction. Such extension ensures smooth wireless LAN communication between the devices located at different positions (heights) in the vertical plane. The antenna device 50 of the embodiment has no directivity in the horizontal plane and provides network environments of high reliability utilizing wireless LAN communication in offices, houses, restaurants, and fast food shops.

In the antenna device 50 of the embodiment, the angle of elevation (or the angle of depression) of the antenna is variable with the antenna case 52. This arrangement ensures adjustment of the antenna to the adequate angle according to the layout of the computers involved in wireless LAN communication, thus attaining preferable communication for wireless LAN.

Figure 9:
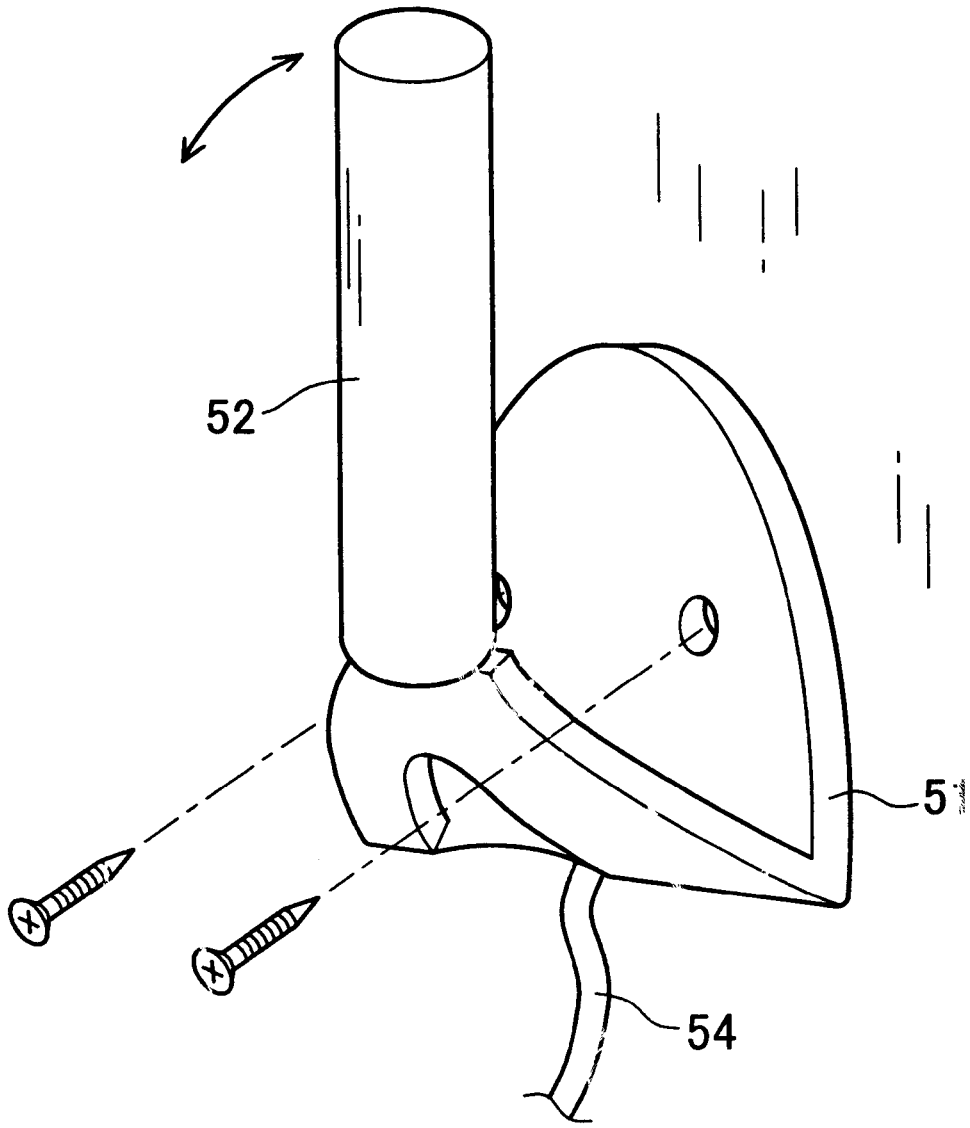
FIG. 9 shows attachment of the antenna device 50 of the embodiment to a wall surface.

The antenna device 50 of the embodiment is fixable to the wall surface with, for example, wood screws fitted in the penetration elements 63 and 64 as shown in FIG. 9. The pivotal rotation of the antenna case 52 to approximately 90 degrees causes vertical orientation of the antenna case 52 as shown in FIG. 9. When the antenna device 50 is fixed at a relatively high position on the wall surface, one preferably arrangement gives some angle of depression to the antenna case 52 and thereby sets the partner device of wireless LAN communication in a range of the high electric field intensity of the antenna device 50. In the case of fixation to the wall surface, no communication is generally expected with computers located in a zone of the rear face side (the wall side). No significant problem thus arises even when the distribution of the electric field in the vertical plane on the rear face side is localized upward due to the angle of depression given to the antenna case 52.

The penetration elements 63 and 64 have the structure to prevent the metal reflector plates 57 and 58 from being in contact with screws in the case of fixation of the antenna device 50, for example, to the wall surface, as shown in FIG. 4. The penetration elements 63 and 64 are not the simple openings, but have their circumferences fitted in the openings formed in the metal reflector plates 57 and 58. Screws are guided along the inner circumferences of the penetration elements 63 and 64 made of a synthetic resin. For example, even in the case of attachment of the antenna device to a metal bookcase with metal screws, there is no electrical connection between the reflector plates 57 and 58 held in the base element 51*a* and the metal appliances. Even in such cases, the directivity characteristics of the antenna device have no significant effects.

Figure 10:
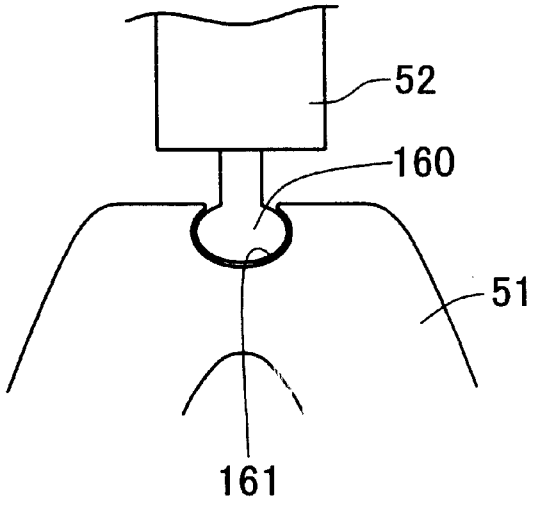
FIG. 10 shows another construction of a joint of an antenna holder module 52 with the base module 51 in the antenna device.

In the embodiment described above, the antenna case 52 is rotated to approximately 90 degrees in one direction by the joint element 60. A diversity of other structures may be applicable to the joint element. For example, as shown in FIG. 10, a spherical joint convex 160 is fitted in a joint concave 161 of a corresponding shape. The antenna case 52 is rotatable in any direction. In another example, a joint rotatable only in a certain direction is mounted on a rotation mechanism rotatable in a plane crossing the certain direction. The joint assembly accordingly allows three-dimensional rotation.

Figure 11:
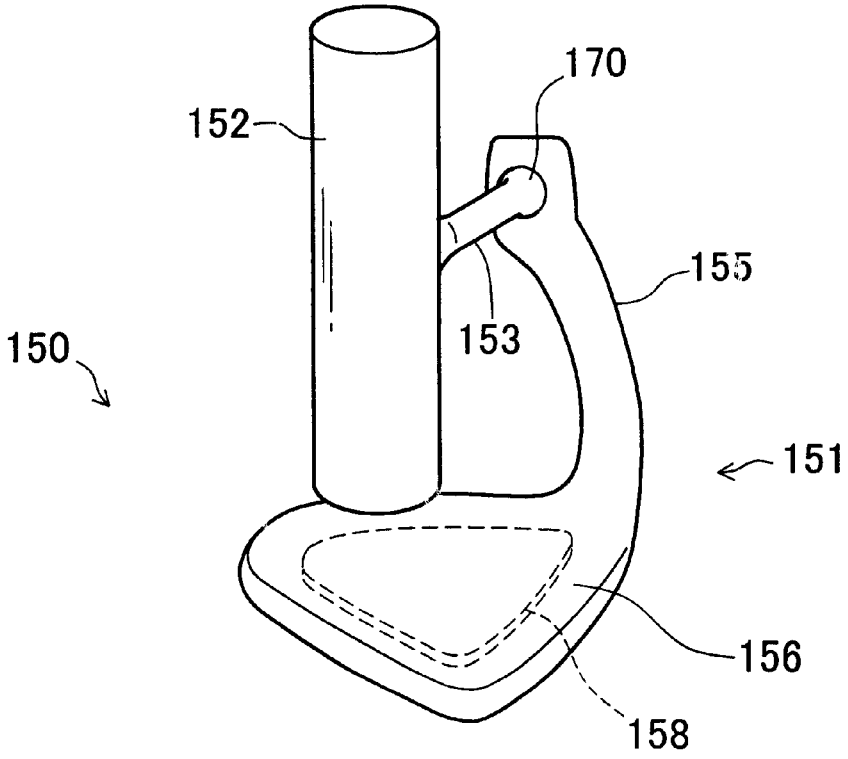
FIG. 11 schematically illustrates the construction of another antenna device for wireless LAN in another embodiment.

In the structure of the above embodiment, the joint element is attached to one end of the antenna case 52. Another applicable structure gives fixation on a center portion of the antenna case 52 as shown in FIG. 11. In tie antenna device 50 shown in FIG. 11, a support arm 153 is fixed to an antenna case 152, and the other end of the support arm 153 is attached to a support arm 155 of a base module 15l to be pivotally rotatable at a joint element 170. A metal reflector plate 158 is held in a base element 156 of the base module 151 like the above embodiment. This modified structure uses only one reflector plate 158.

In the antenna device 150 of this modified structure, the presence of the reflector plate 158 remarkably extends the distribution of the electric field intensity in the vertical plane and thereby exerts the similar effects to those of the embodiment described above.

The above embodiment and its modifications are to be considered in all aspects as illustrative and not restrictive. There may be many modifications, changes, and alterations without departing from the scope or spirit of the main characteristics of the present invention. The scope and spirit of the present invention are indicated by the appended claims, rather than by the foregoing description.

What is claimed is:

1. A non-directivity antenna device for wireless LAN used in connection with a wireless LAN device, said antenna device comprising:

a base module that has a predetermined bottom area;

a columnar case that is connected to said base module with a degree of freedom in at least one axis;

an antenna main body that is received in said columnar case and has no directivity around an axis of said antenna main body; and an electrically conductive, reflector plate that is held in said base module.

2. An antenna device for wireless LAN in accordance with claim 1, wherein said base module comprises:

a plate-like base element that has a predetermined area and receives said reflector plate therein; and an extension element that is (extended from slid base element at a predetermined angle, said base module is connected to said columnar case at a top of said extension element.

3. An antenna device for wireless LAN in accordance with claim 2, wherein said extension element has two legs that are branched off from the top, which is connected to said case, and are respectively linked with said base element.

4. A an antenna device for wireless LAN in accordance with claim 2, wherein said base element has a portion for forming a fixation aperture, which a fixation member used for fixation passes through.

5. An antenna device for wireless LAN in accordance with claim 1, wherein the connection of said case with said base module is attained by attaching one end of said case to said base module, and degree of freedom in at least one axis represents movability of said case about one end of said case as a supporting point in a direction crossing an axis of said case.

6. An antenna device for wireless LAN in accordance with claim 5, said antenna device further comprising a universal joint connecting said case to said base module.

7. An antenna device for wireless LAN in accordance with claim 1, wherein said base module comprise said electrically conductive reflector plate molded in a non-conductive member.

8. An antenna device for wireless LAN in accordance with claim 1, wherein said case is cylindrical.

9. A wireless LAN device to which a non-directivity antenna device is connected, said non-directivity antenna device comprising:

a base module that has a predetermined bottom area;

a columnar case that is connected to said base module with a degree of freedom in at least one axis;

an antenna main body that is received in said columnar case and has no directivity around an axis;

an electrically conductive reflector plate that is held in said base module;

a cable that is used for electrical connection of said non-directivity antenna device, wherein said wireless LAN device is connected with said non-directivity antenna device via said cable.

* * * * *

UNITED STATES PATENT AND TRADEMARK OFFICE

CERTIFICATE OF CORRECTION

PATENT NO. : 6,646,612 B1
DATED : November 11, 2003
INVENTOR(S) : Wataru Noguchi et al.

It is certified that error appears in the above-identified patent and that said Letters Patent is hereby corrected as shown below:

Column 1,
Line 41, change “bean” to -- been --
Line 48, change “or” to -- on --
Line 48, after “hand” delete “an”

Column 5,
Line 20, after “is” delete “a”

Column 7,
Line 14, change “(extended from slid” to -- extended from said --

Column 8,
Line 1, before “degree” add -- the --
Line 9, change “comprise” to -- comprises --

Signed and Sealed this

Ninth Day of November, 2004

JON W. DUDAS
*Director of the United States Patent and Trademark Office*